US010571216B2

(12) United States Patent
Kung et al.

(10) Patent No.: US 10,571,216 B2
(45) Date of Patent: Feb. 25, 2020

(54) BALLISTIC ADJUSTING STRUCTURE OF TOY GUN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 16/399,995

(22) Filed: Apr. 30, 2019

(65) Prior Publication Data

US 2019/0360775 A1 Nov. 28, 2019

(30) Foreign Application Priority Data

May 24, 2018 (TW) ..... 107206855 A

(51) Int. Cl.
*F41B 11/00* (2013.01)
*F41B 11/70* (2013.01)
*F41B 11/89* (2013.01)

(52) U.S. Cl.
CPC ..... *F41B 11/70* (2013.01); *F41B 11/89* (2013.01)

(58) Field of Classification Search
CPC ..... F41B 11/00; F41B 11/70
See application file for complete search history.

(56) References Cited

U.S. PATENT DOCUMENTS

| | | | | |
|---|---|---|---|---|
| 5,655,510 | A * | 8/1997 | Kunimoto | F41B 11/00 124/81 |
| 7,980,238 | B2 * | 7/2011 | Wood | F41A 11/02 124/73 |
| 8,714,146 | B2 * | 5/2014 | Hu | F41A 21/12 124/83 |
| 9,103,624 | B1 * | 8/2015 | Kung | F41B 11/62 |
| 9,541,346 | B1 * | 1/2017 | Huang | F41B 11/89 |
| 2007/0125351 | A1 * | 6/2007 | Campo | F41A 21/32 124/56 |

* cited by examiner

*Primary Examiner* — John A Ricci
(74) *Attorney, Agent, or Firm* — Chun-Ming Shih; HDLS IPR Services

(57) ABSTRACT

A ballistic adjusting structure of toy gun is capable of allowing a bullet to be in a hopping up status and includes: a base; an inner barrel; a robbing cylinder having a robbing part; an adjusting pipe having a free end and a pivotal end pivoted to the base and formed with a spiral guiding slot; an operation member having a driven part penetrated into the spiral guiding slot and a driving part operating the robbing cylinder. When the free end is driven by an external force to drive the pivotal end to be rotated, the driven part is guided by the spiral guiding slot to drive the driving part to be displaced, and the displacement of the driving part is able to operate on the robbing cylinder for altering a location where the robbing part is arranged in the inner barrel.

10 Claims, 10 Drawing Sheets

BALLISTIC ADJUSTING STRUCTURE OF TOY GUN

BACKGROUND OF THE INVENTION

Field of the Invention

The present invention relates to a toy gun, especially to a ballistic adjusting structure of toy gun.

Description of Related Art

For allowing the ballistic of a fired bullet to be stabilized, an inner wall of a gun barrel would be carved with a spiral rifling, so that when the bullet is forwardly displaced inside the gun barrel, the bullet is able to be rotated in a high speed so as to stabilize the ballistic, increase the firing range and precisely hit a desired target.

However, the structure of a toy gun is relatively simpler, the inner wall of a gun barrel is not provided with a rifling for guiding the bullet to be rotated, thus even if a user has already accurately aim at the desired target, the fired bullet may be deviated from the target because the actual ballistic is not stable and the firing range is not enough.

Accordingly, a rubbing member is provided inside the gun barrel of a toy gun for allowing a fired bullet to rub against the robbing member to generate a hopping up status, so that the parabola is increased, the ballistic is stabilized and the firing range is expanded.

However, there are some disadvantages existed in a conventional ballistic adjusting device of toy gun, as follows: more components are required in the conventional ballistic adjusting device, thus a problem of not easy to be assembled is caused, the volume thereof is enlarged, and the layout of other structures in the toy gun would be affected.

Accordingly, the applicant of the present invention has devoted himself for improving the mentioned disadvantages.

SUMMARY OF THE INVENTION

The present invention is to provide a ballistic adjusting structure of toy gun, which has effects of simplifying the structure for altering the ballistic of a bullet, decreasing the volume of the ballistic adjusting structure and providing an easy assembling convenience.

Accordingly, the present invention provides a ballistic adjusting structure of toy gun, which includes: a base; an inner barrel, inserted in the base; a robbing cylinder, sleeved with the inner barrel, and having a robbing part arranged in the inner barrel; an adjusting pipe, having a pivotal end and a free end oppositely arranged, wherein the pivotal end is rotatably pivoted to the base and formed with a spiral guiding slot, and the spiral guiding slot is able to be rotated with the adjusting pipe via the pivotal end; and an operation member, moveably disposed in the base and having a driven part and a driving part, wherein the driven part is protruded into the spiral guiding slot, and the driving part is served to operate on the robbing cylinder; wherein, the free end of the adjusting pipe is driven by an external force to drive the pivotal end to be rotated, the driven part of the operation member is guided by the spiral guiding slot to drive the driving part to be displaced, and the displacement of the driving part is able to operate on the robbing cylinder for altering a location where the robbing part being arranged in the inner barrel.

In comparison with related art, the present invention has advantageous features as follows. The present invention has effects of simple structure, smaller volume and easy assembly.

DETAILED DESCRIPTION OF THE INVENTION

A preferred embodiment of the present invention will be described with reference to the drawings.

The present invention provides a ballistic adjusting structure of toy gun, which enables a fired bullet to be in a hopping up status with a simplified structure, so that the hopping up status allows the bullet to be upwardly offset so as to alter the ballistic, thereby increasing the parabola, expanding the firing range and stabling the ballistic.

Figure 1:
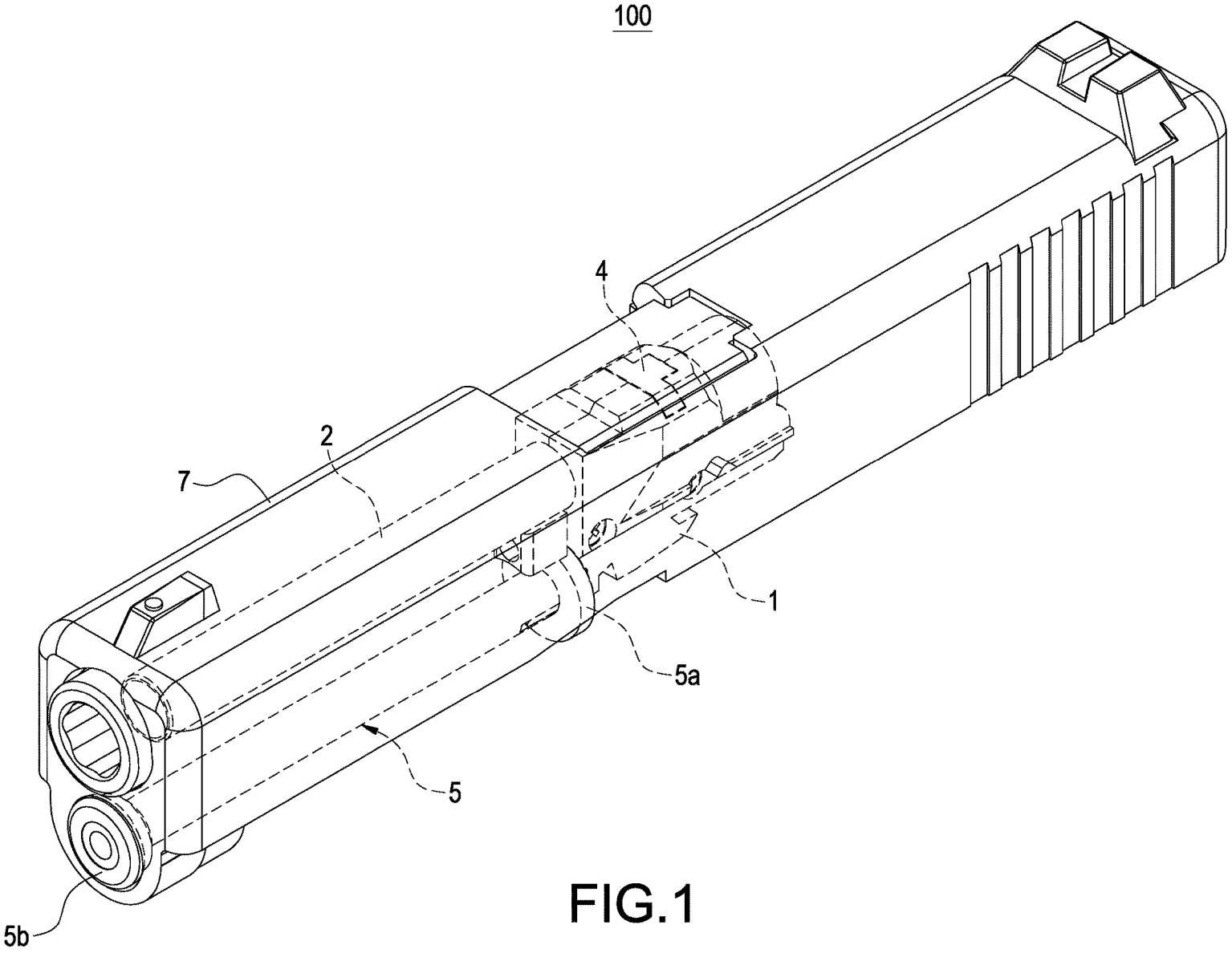
FIG. 1 is a perspective view showing a gun barrel according to the present invention.
Figure 2:
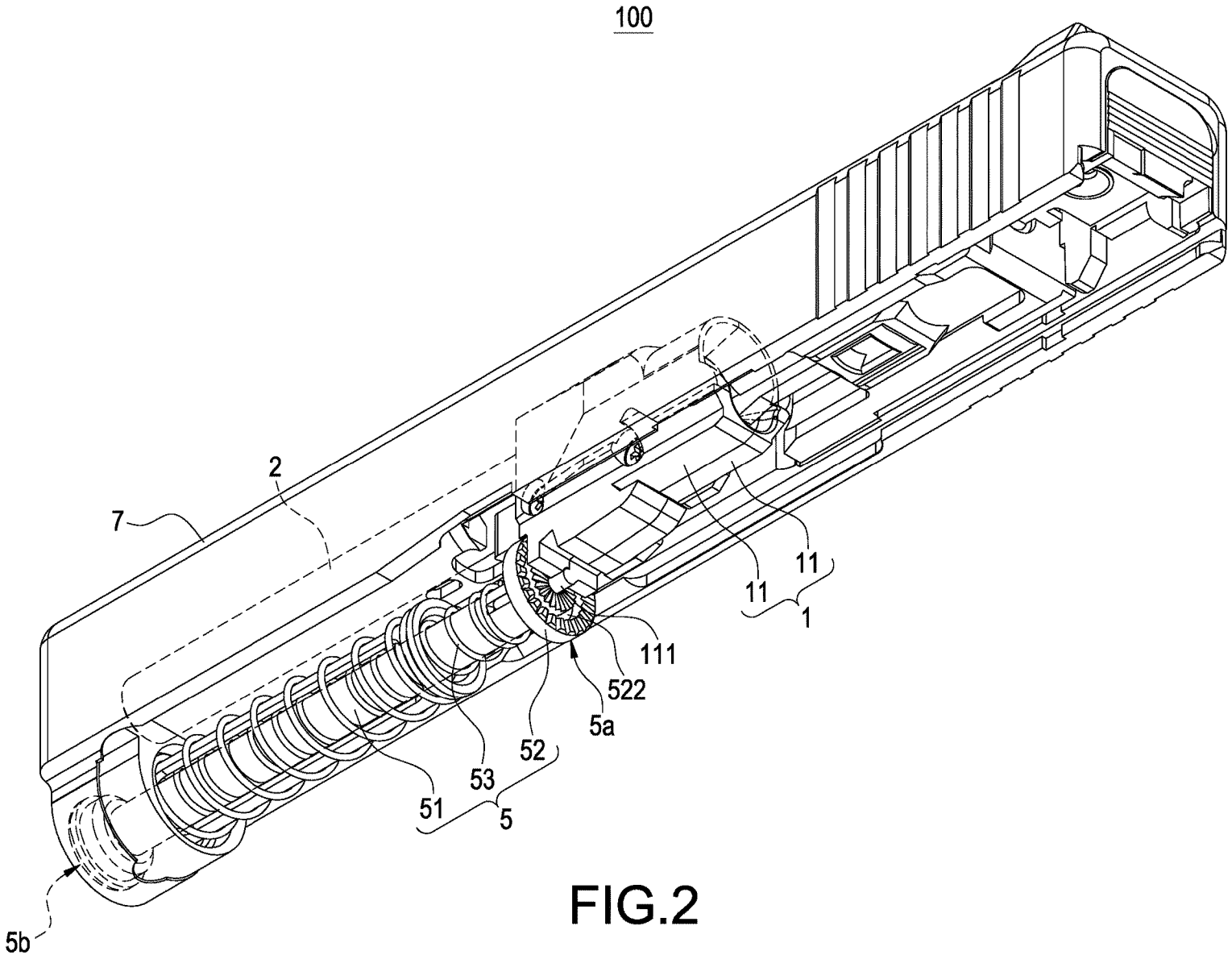
FIG. 2 is another perspective view showing the gun barrel according to the present invention.
Figure 6:
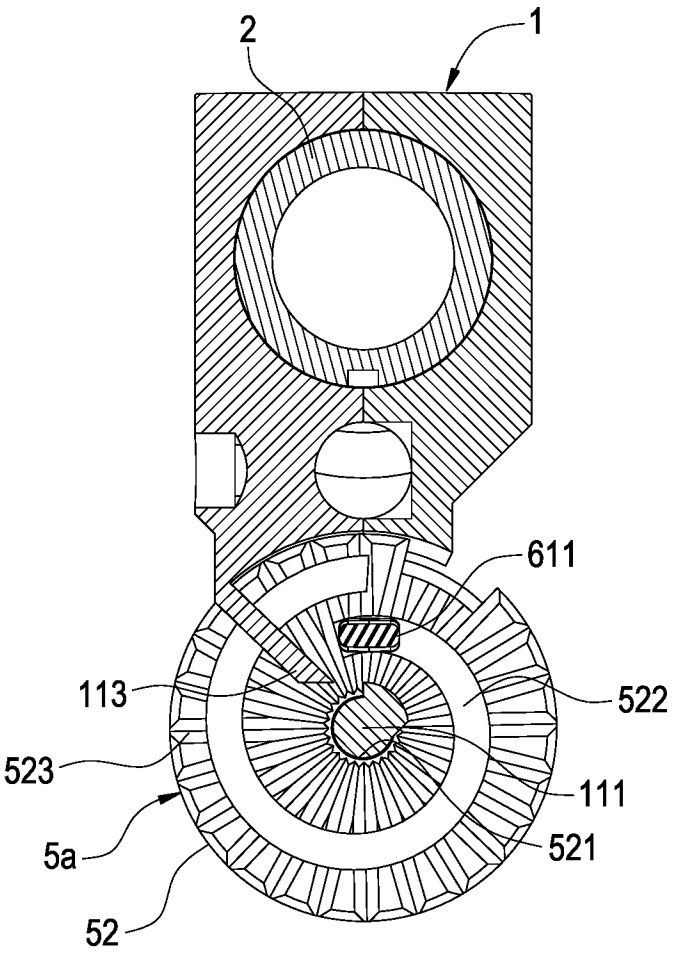
FIG. 6 is a cross sectional view of FIG. 4 according to the present invention.
Figure 7:
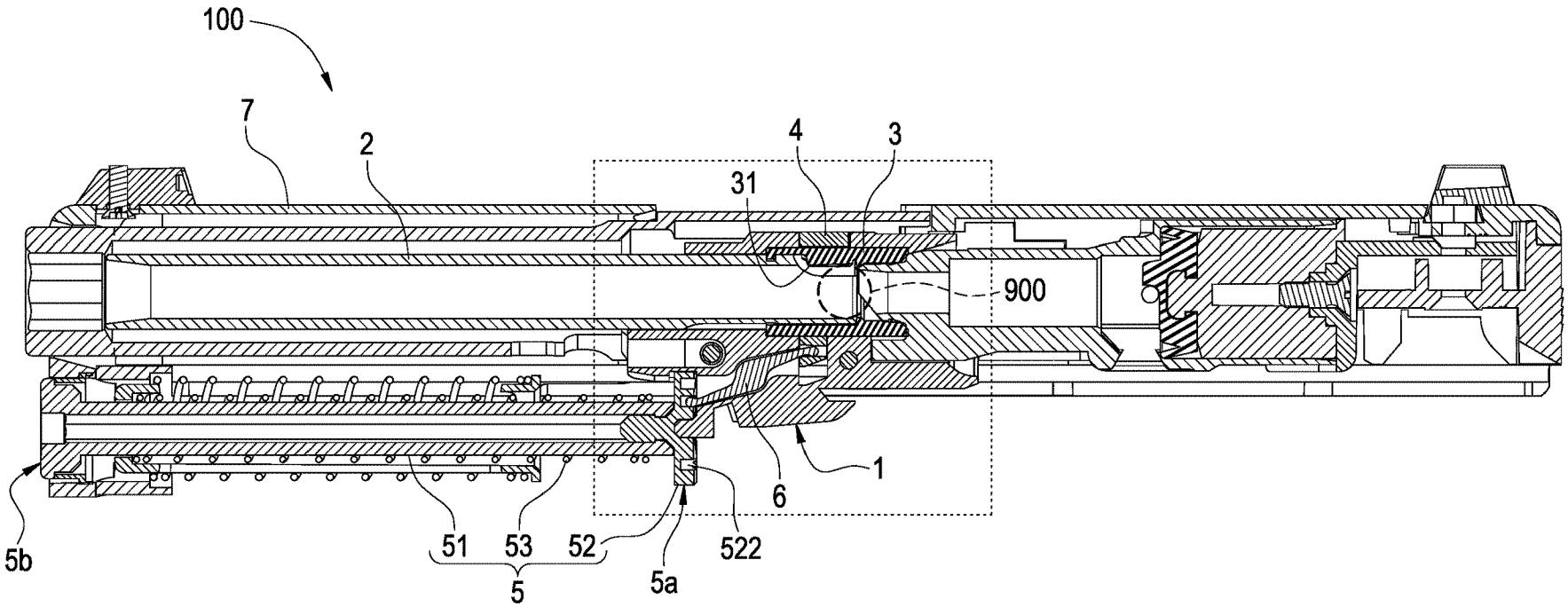
FIG. 7 is a cross sectional view showing the gun barrel before the adjusting process being performed according to the present invention.

Please refer from FIG. 1 to FIG. 8, the ballistic adjusting structure of toy gun provided by the present invention includes: a base 1, an inner barrel 2, a rubbing cylinder 3, an adjusting pipe 5 and an operation member 6, and preferably includes a sleeve ring 4 and a housing 7 (as shown in FIG. 1, FIG. 2 and FIG. 7). The base 1, the inner barrel 2 and the adjusting pipe 5 are enclosed by the housing 7 so as to form a gun barrel 100, in other words the ballistic adjusting structure of the present invention is disposed in the gun barrel 100 of a toy gun, but what shall be addressed is that the scope of the present invention is not limited to the above-mentioned arrangement.

The base 1 cannot only be formed as a single-piece structure (not shown in figures), but also can be formed as a two-piece structure as shown in figures. The base 1 formed in the two-piece structure includes two base pieces 11 capable of being mutually engaged, an inner end of the inner barrel 2 is inserted in the base 1, so that a notch 21 (as shown in FIG. 8) formed at the inner end of the inner barrel 2 is allowed to be located inside the base 1.

Figure 3:
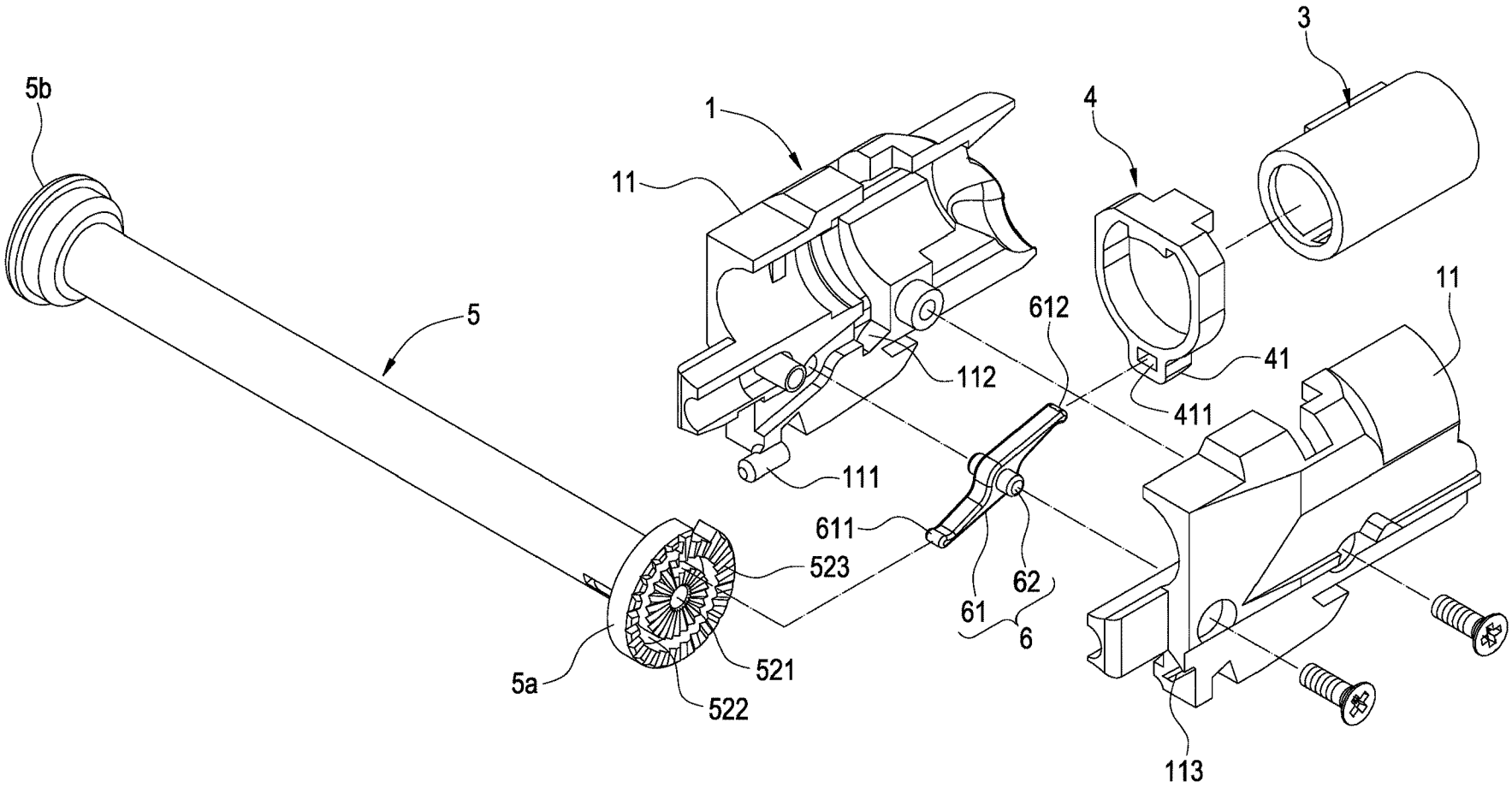
FIG. 3 is a perspective exploded view showing the gun barrel wherein an inner barrel and a housing not being shown according to the present invention.
Figure 4:
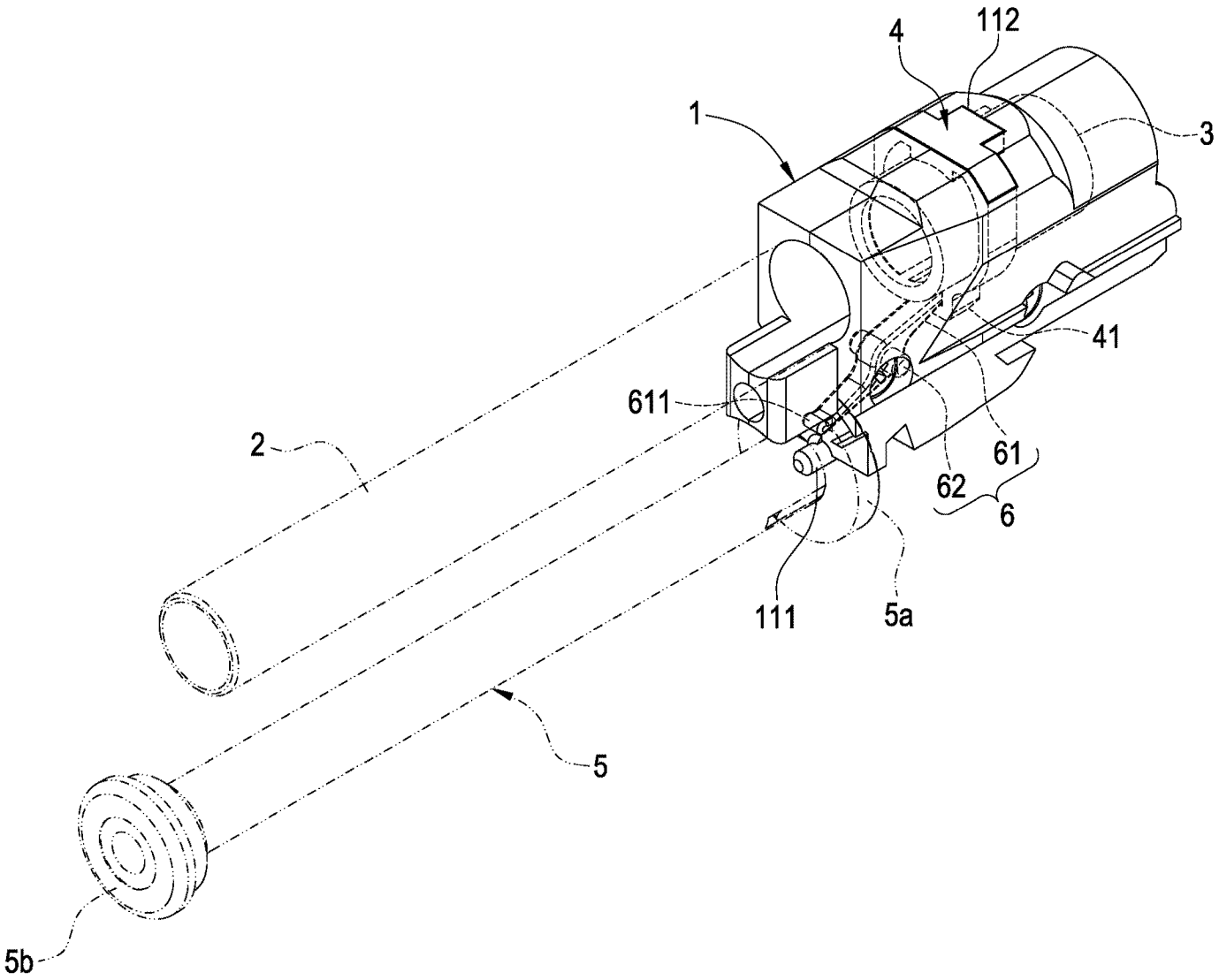
FIG. 4 is a perspective view showing the assembly of the gun barrel wherein the housing not being shown according to the present invention.
Figure 5:
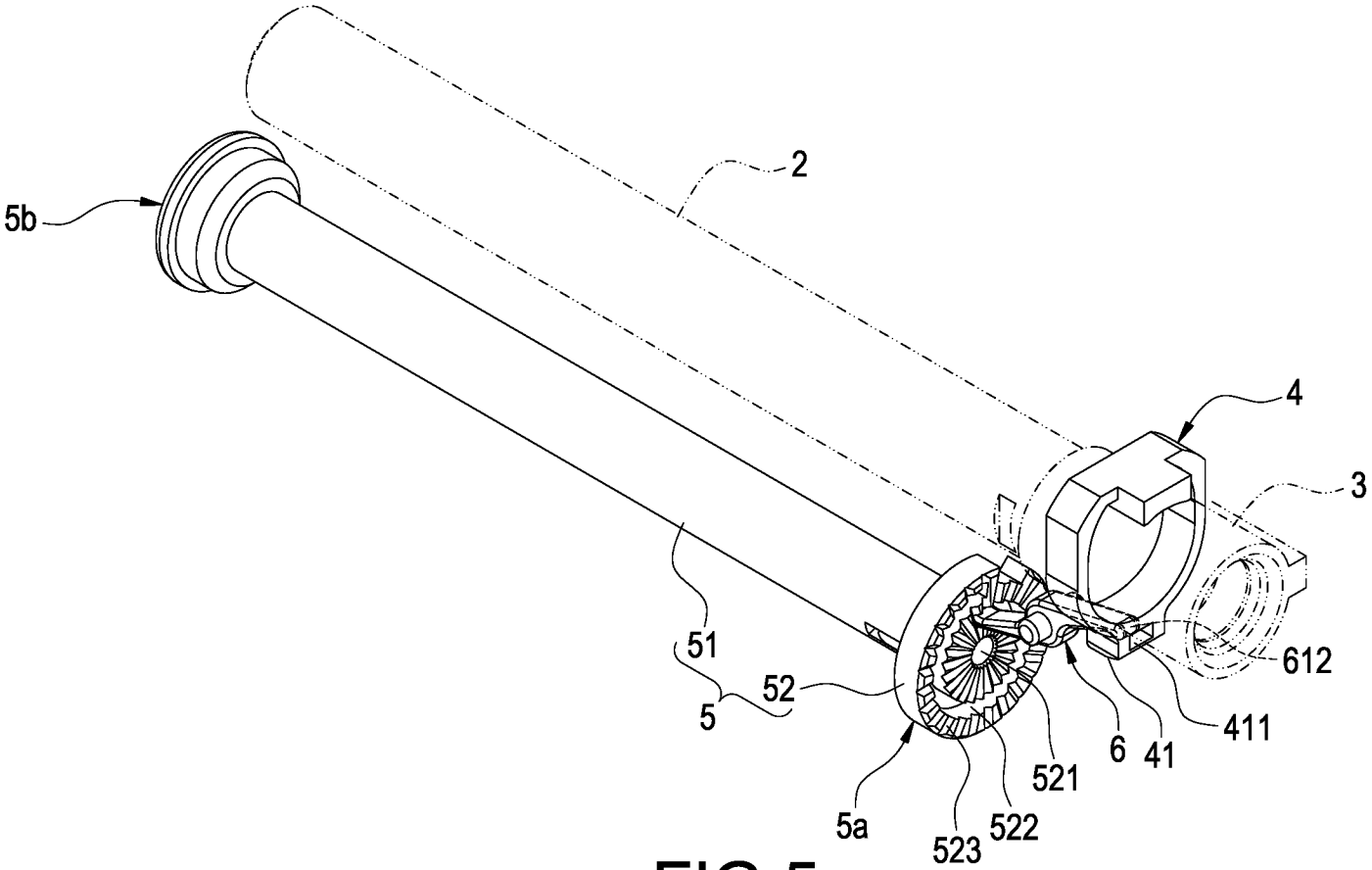
FIG. 5 is another perspective view showing the gun barrel of FIG. 4 wherein a base not being shown (before an adjusting process being performed) according to the present invention.
Figure 8:
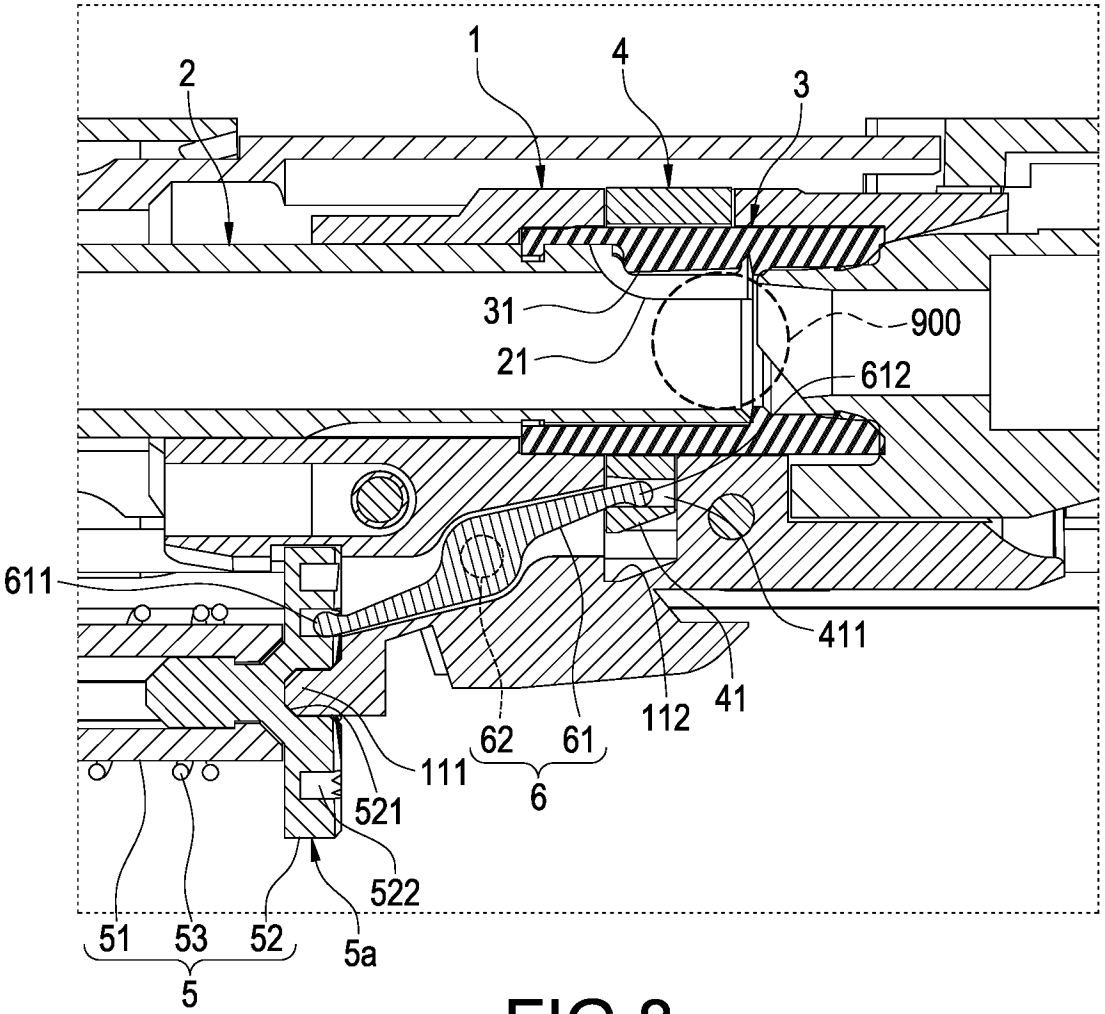
FIG. 8 is a partially enlarged view of FIG. 7 according to the present invention.

Preferably, a pivotal shaft 111 is disposed in the base 1 and extended along a length direction of the inner barrel 2, a slide slot 112 (as shown in FIG. 3, FIG. 4 and FIG. 8) having sliding and guiding functions is formed inside the base 1, and a sliding and guiding direction of the slide slot 112 is crossly arranged corresponding to the length direction of the inner barrel 2.

The rubbing cylinder 3 is made of an elastic material and sleeved at the inner end of the inner barrel 2, a rubbing part 31 (as shown in FIG. 7 and FIG. 8) protruded out from an inner wall of the rubbing cylinder 3 is correspondingly arranged in the notch 21, the location where the rubbing part 31 being arranged in the inner barrel 2 can be altered through the rubbing cylinder 3 being elastically deformed, in other words the rubbing part 31 is originally not protruded out from an inner wall of the inner barrel 2, and altered to be protruded out from the inner wall of the inner barrel 2.

The adjusting pipe 5 has a pivotal end 5*a* and a free end 5*b* which are oppositely arranged. The pivotal end 5*a* is rotatably pivoted to the base 1, so that the adjusting pipe 5 can be driven to be rotated. The pivotal end 5*a* is formed with a spiral guiding slot 522, so that the spiral guiding slot 522 can be rotated with the adjusting pipe 5 via the pivotal end 5*a*. The free end 5*b* is exposed outside the housing 7.

Preferably, the pivotal end 5*a* of the adjusting pipe 5 is formed with an end surface (not provided with a code), the end surface has a first pivotal part 521 and formed with the above-mentioned spiral guiding slot 522; as shown in FIG. 6, the spiral guiding slot 522 is served to spirally surround the first pivotal part 521, and the spiral guiding slot 522 has an adjusting high point (for example a spiral outer end of the spiral guiding slot 522) and an adjusting low point (for example a spiral inner end of the spiral guiding slot 522). As shown in figures, the pivotal end 5*a* is pivoted with the base 1 via the first pivotal part 521, the first pivotal part 521 can be a pivotal hole formed along a length direction of the adjusting pipe 5 for allowing the pivotal shaft 111 to be pivoted corresponding to the pivotal hole.

The operation member 6 is moveably disposed on the base 1, and the pivotal end 5*a* can be driven by the operation member 6 to drive the rubbing cylinder 3 to be displaced. The operation member 6 has a driven part 611 and a driving part 612. The driven part 611 is protruded into the spiral guiding slot 522 so as to be linked, and the driving part 612 is operated on the rubbing cylinder 3. As shown in FIG. 6, before an adjusting process is performed, the driven part 611 is located at the adjusting low point of the spiral guiding slot 522; in other words after the adjusting process is performed, the driven part 611 is located at the adjusting high point.

According to the present invention, the structure of the operation member 6 is not specially limited as long as the operation member 6 can be guided by the spiral guiding slot 522 for being operated on the rubbing cylinder 3. According to this embodiment, details are provided as follows: the operation member 6 has an arm body 61 and a second pivotal part 62, the driven part 611 and the driving part 612 are disposed at two ends of the arm body 61, the second pivotal part 62 is disposed between the driven part 611 and the driving part 612 and pivoted to the base 1, so that the arm body 61 can be operated in a seesaw fashion with the second pivotal part 62 being served as a pivot.

The sleeve ring 4 is sleeved on the rubbing cylinder 3 corresponding to the location of the rubbing part 31, and the sleeve ring 4 and a protrusion 41 thereof are connected to the slide slot 112 with a sliding means, so that the sleeve ring 4 is enabled to be slid along the slide slot 112 relative to the rubbing cylinder 3; and the driving part 612 of the operation member 6 is connected to the sleeve ring 4, so that the operation member 6 is enabled to operate on the rubbing cylinder 3 via the sleeve ring 4. According to the present invention, the means of the driving part 612 being connected to the sleeve ring 4 is not specially limited; according to this embodiment, a means of the protrusion 41 being protruded out from the sleeve ring 4 and an insertion hole 411 being formed on the protrusion 41 is provided as an example, the operation member 6 is enabled to drive the sleeve ring 4 to slide through the driving part 612 being protruded into the insertion slot 411.

Accordingly, when a user applies a force to the free end 5*b* to control the adjusting pipe 5 to be rotated, the pivotal end 5*a* is rotated with the adjusting pipe 5 so as to control a rotation angle of the spiral guiding slot 522.

Details are provided as follow. As shown in FIG. 6, FIG. 7 and FIG. 8, when the spiral guiding slot 522 is rotated to a first angle, the driven part 611 of the operation member 6 is located at the adjusting low point of the spiral guiding slot 522, and the driving part 612 of the operation member 6 is located at a relative high point, so that the sleeve ring 4 is driven to be upwardly slid along the slide slot 112 for allowing the sleeve ring 4 not to press the rubbing cylinder 3, and the rubbing part 31 is not protruded out from the inner wall of the inner barrel 2, the above-mentioned status is defined as a first adjusting status of the ballistic, a bullet 900 would not rub against the rubbing part 31 after being fired, so that a hopping up status is not generated.

Figure 9:
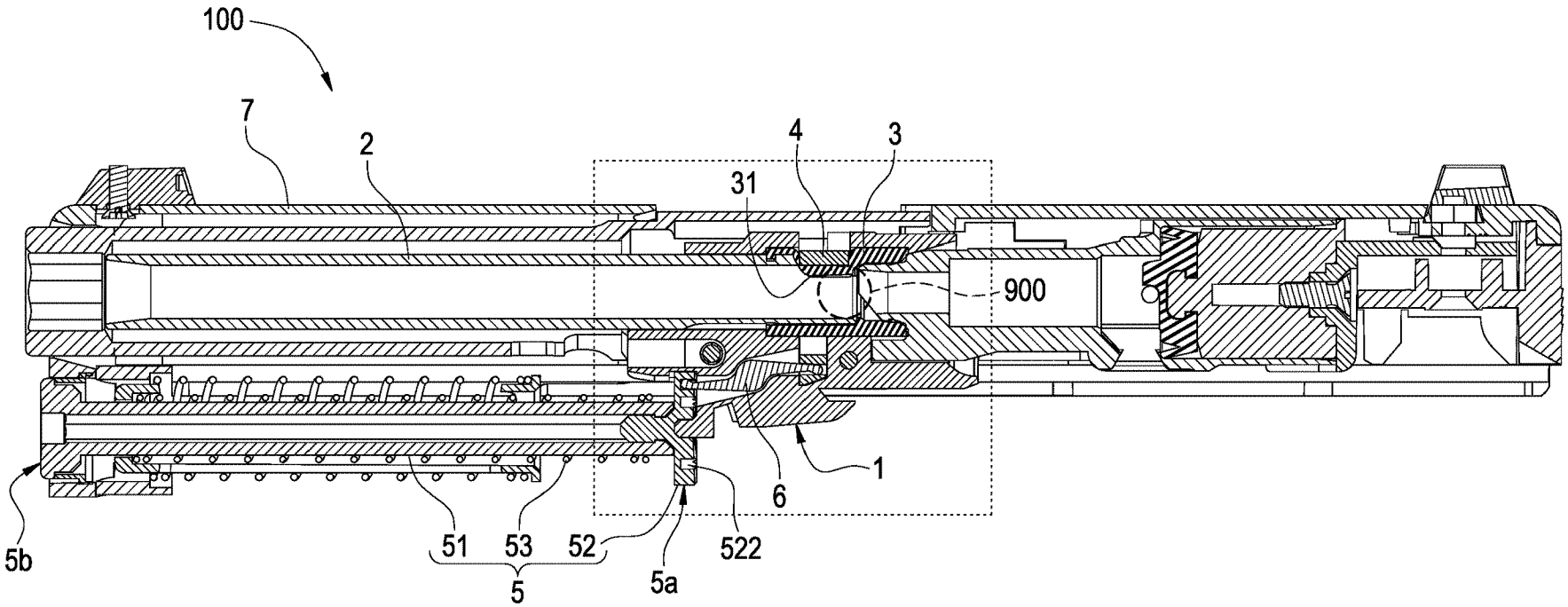
FIG. 9 is a cross sectional view showing the gun barrel after the adjusting process being performed according to the present invention.
Figure 10:
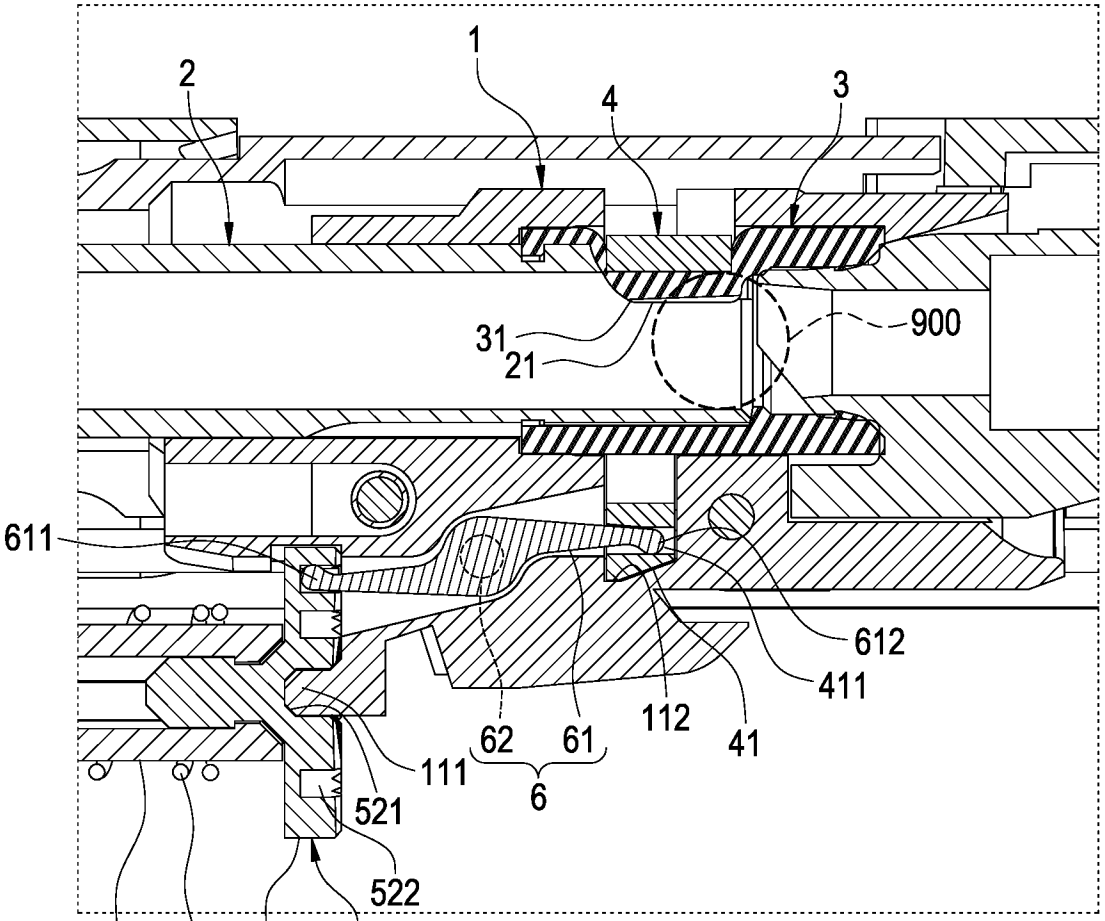
FIG. 10 is a partially enlarged view of FIG. 9 according to the present invention.

As shown in FIG. 9 and FIG. 10, when the spiral guiding slot 522 is rotated to a second angle, the driven part 611 of the operation member 6 is located at the adjusting high point of the spiral guiding slot 522, and the driving part 612 of the operation member 6 is located at a relative low point, so that the sleeve ring 4 is driven to be downwardly slid along the slide slot 112 for allowing the sleeve ring 4 to rob against the rubbing cylinder 3 at the location corresponding to the rubbing part 31, and the rubbing part 31 is protruded out from the inner wall of the inner barrel 2, the above-mentioned status is defined as a second adjusting status of the ballistic, the bullet 900 would rob against the rubbing part 31 after being fired, so that the hopping up status is generated.

According to other embodiments which are not shown in figures, the sleeve ring 4 is not required, the driving part 612 of the operation member 6 can be directly connected and served to press the rubbing cylinder 3 at the location corresponding to the rubbing part 31, so that when the driving part 612 is served to press the rubbing cylinder 3, the rubbing cylinder 3 is deformed for altering the location where the rubbing part 31 being arranged in the inner barrel 2.

According to the present invention, a concave/convex teeth structure 523 can be additionally disposed on the end surface of the pivotal end 5*a*, and a protruding piece 113 is additionally disposed on the base 1. Wherein, the first pivotal part 521 is surrounded by the concave/convex teeth structure 523, the protruding piece 113 is correspondingly latched in one of teeth slots of the concave/convex teeth structure 523, so that when the user applies a force to enable the adjusting pipe 5 to be rotated, the concave/convex teeth structure 523 rotated with the pivotal end 5*a* is able to slide through the protruding piece 113 for making a sound and generating an adjusting feeling which can be felt by the user, the user can even obviously feel the protruding piece 113 sliding through each teeth of the concave/convex teeth structure 523, thus the user can clearly know a current adjusting process (or a rotation angle) of the adjusting pipe 5.

Preferably, the adjusting pipe 5 includes a pipe body 51, an elastic unit 53 and a rotary disk 52 connected to one end of the pipe body 51. The rotary disk 52 is rotated with the pipe body 51, and the elastic unit 53 is sleeved on the pipe body 51 and served to elastically support the rotary disk 52. As shown in figures, the elastic unit 53 is served to elastically support a back side (not provided with a code) of the rotary disk 52 as shown in FIG. 7, the first pivotal part 521, the spiral guiding slot 522 and the concave/convex teeth structure 523 are disposed on a front side (not provided with a code) of the rotary disk 52, so that the rotary disk 52 is provided with an elastic supporting force in a direction defined from the front side towards to the back side via the elastic unit 53, thereby allowing the adjusting feeling provided to the user to be greatly enhanced. Wherein, the pivotal end 5*a* is formed through the rotary disk 52 being connected to one end of the pipe body 51, thus the front side of the rotary disk 52 can be defined as the end surface of the pivotal part 5*a*.

Based on what has been disclosed above, advantages achieved by the present invention are as follows: the fired bullet 900 can be in the hopping up status with a simplified structured, so that the volume of the ballistic adjusting structure can be reduced (an overly-large size would affect the layout of other structures of the toy gun), and an effect of easy assembly is also provided.

Moreover, other effects are provided to the present invention: with the concave/convex teeth structure 523 and the protruding piece 113, a sound and an adjusting feeling which can be felt by the user during the adjusting process can be generated, and the user can even clearly know the current adjusting process (or the rotation angle) for being provided with a more precise adjusting effect.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A ballistic adjusting structure of toy gun, including: a base (1);

an inner barrel (2), inserted in the base (1);

a rubbing cylinder (3), sleeved with the inner barrel (2), and having a rubbing part (31) arranged in the inner barrel (2);

an adjusting pipe (5), having a pivotal end (5*a*) and a free end (5*b*) oppositely arranged, wherein the pivotal end (5*a*) is rotatably pivoted to the base (1) and formed with a spiral guiding slot (522), and the spiral guiding slot (522) is able to be rotated with the adjusting pipe (5) via the pivotal end (5*a*); and an operation member (6), moveably disposed in the base (1) and having a driven part (611) and a driving part (612), wherein the driven part (611) is protruded into the spiral guiding slot (522), and the driving part (612) is served to operate on the rubbing cylinder (3);

wherein, the free end (5*b*) of the adjusting pipe (5) is driven by an external force to drive the pivotal end (5*a*) to be rotated, the driven part (611) of the operation member (6) is guided by the spiral guiding slot (522) to drive the driving part (612) to be displaced, and the displacement of the driving part (612) is able to operate on the rubbing cylinder (3) for altering a location where the rubbing part (31) being arranged in the inner barrel (2).

2. The ballistic adjusting structure of toy gun according to claim 1, further including a sleeve ring (4), the sleeve ring (4) is sleeved on the rubbing cylinder (3) corresponding to a location of the rubbing part (31), the driving part (612) of the operation member (6) is connected to the sleeve ring (4), so that the operation member (6) is enabled to press the rubbing cylinder (3) through the driving part (612) driving the sleeve ring (4) to be displaced so as to alter a location where the rubbing member (31) being arranged in the inner barrel (2).

3. The ballistic adjusting structure of toy gun according to claim 2, wherein the sleeve ring (4) is formed with an insertion hole (411), the driving part (612) of the operation member (6) is inserted in the insertion hole (411), thereby being able to drive the sleeve ring (4).

4. The ballistic adjusting structure of toy gun according to claim 3, wherein the base (1) is formed with a slide slot (112), the sleeve ring (4) is protruded with a protrusion (41), the insertion hole (411) is formed on the protrusion (41), the sleeve ring (4) and the protrusion (41) are connected to the slide slot (112) with a sliding means, and the sleeve ring (4) is enabled to be slid along the slide slot (112) relative to the rubbing cylinder (3).

5. The ballistic adjusting structure of toy gun according to claim 1, wherein the pivotal end (5*a*) is formed with an end surface, the end surface is formed with a first pivotal part (521) and the spiral guiding slot (522) surrounding the first pivotal part (521), and the pivotal end (5*a*) is pivoted to the base (1) via the first pivotal part (521).

6. The ballistic adjusting structure of toy gun according to claim 5, wherein the base (1) has a pivotal shaft (111), and the first pivotal part (521) is a pivotal hole formed along a length direction of the adjusting pipe (5) for allowing the pivotal shaft (111) to be pivoted corresponding to the pivotal hole.

7. The ballistic adjusting structure of toy gun according to claim 5, wherein the end surface is formed with a concave/convex teeth structure (523) surrounding the first pivotal part (521), the base (1) is disposed with a protruding piece (113), the protruding piece (113) is correspondingly latched in the concave/convex teeth structure (523), and the concave/convex teeth structure (523) is able to slide through the protruding piece (113) through the pivotal end (5*a*) being rotated with the adjusting pipe (5).

8. The ballistic adjusting structure of toy gun according to claim 1, wherein the operation member (6) has an arm body (61) and a second pivotal part (62), the driven part (611) and the driving part (612) are disposed at two ends of the arm body (61), and the second pivotal part (62) is disposed between the driven part (611) and the driving part (612) and pivoted to the base (1).

9. The ballistic adjusting structure of toy gun according to claim 1, wherein the adjusting pipe (5) includes a pipe body (51), an elastic unit (53) and a rotary disk (52) connected to one end of the pipe body (51) so as to form the pivotal end (5*a*), the rotary disk (52) is rotated with the pipe body (51), and the elastic unit (53) is sleeved with the pipe body (51) and served to elastically support the rotary disk (52).

10. The ballistic adjusting structure of toy gun according to claim 9, wherein the rotary disk (52) is formed with a back side and a front side oppositely arranged, the elastic unit (53)

is served to elastically support the back side, and the spiral guiding slot (522) is formed on the front side.

* * * * *